United States Patent [19]

Alt et al.

[11] Patent Number: 4,510,862

[45] Date of Patent: Apr. 16, 1985

[54] DISPOSABLE STRIP ASSEMBLY AND RETENTION DEVICE FOR A LINE PRINTER

[75] Inventors: Richard C. Alt, Vestal; Joseph Pinter, Apalachin, both of N.Y.

[73] Assignee: International Business Machines Corporation, Armonk, N.Y.

[21] Appl. No.: 577,642

[22] Filed: Feb. 6, 1984

[51] Int. Cl.[3] ..... B41J 1/16; B41J 1/20

[52] U.S. Cl. ..... 101/93.14; 101/105; 101/111; 101/425; 15/256.51; 400/146

[58] Field of Search ..... 101/93.13, 93.14, 105, 101/111, 425; 400/146; 15/256.51

[56] References Cited

U.S. PATENT DOCUMENTS 4,211,166 7/1980 Hardt ..... 101/111

OTHER PUBLICATIONS

Bayer, Printer Platen for Band Printer, IBM Tech. Disclosure Bull., vol. 25, No. 7A, Dec. 1982, p. 3521.

Legg, Magnetic Print Belt Cleaner, Jun. 1973, IBM Technical Disclosure Bulletin, vol. 16, No. 1, p. 143.

*Primary Examiner*—Clyde I. Coughenour
*Assistant Examiner*—William L. Klima
*Attorney, Agent, or Firm*—John S. Gasper

[57] ABSTRACT

A strip assembly for a printing device having an endless type band frictionally driven by drive and idler pulleys between print hammers and a platen comprises a wear strip and wiper strip attached together at a common end. The wiper strip has a wiper portion extending from the point of attachment which terminates in a scraper edge. A retention device mounted in proximity with the drive pulley comprises means connectable to the common end to hold said wear strip under tension and said wiper strip in spring loaded condition with the scraper edge in contact with the drive surface of the drive pulley for cleaning wear strip residue and other deposits from the pulleys and the type band.

20 Claims, 7 Drawing Figures

10
11
12
13
14
15
16
17
18
19
20
21
22
23
24
25
26
27
28
29
31
36
37
41
42
43
44
45
46

11
12
13
14
26
27
28
30
31
32
33
34
35
36

36
37a
37b
38
39
40
41

36
37a
37b
39
40
41

11
12
13
14

DISPOSABLE STRIP ASSEMBLY AND RETENTION DEVICE FOR A LINE PRINTER

FIELD OF THE INVENTION

The invention relates in general to printing apparatus and especially to a printing apparatus, such as a line printer of the type having an endless movable type carrier with a plurality of printing hammers striking a print medium against type elements on the type carrier and a platen against which the type carrier is pressed as a result of the hammers striking the print medium against the type.

BACKGROUND OF THE INVENTION

The endless carrier is constructed from a flexible metal band such as steel with a row of uniformly spaced engraved type characters and one or more rows of indicia marks. The indicia marks are designed for sensing by emitters while the type band is revolved relative to a row of print hammers which strikes a print medium against the type characters. The drive system for revolving the metal band at constant speed commonly comprises a pair of spaced rotatable pulleys one of which is a drive pulley and the other an idler pulley. The endless type band is partially wrapped around the pulleys in tension so as to be driven by contact friction of the drive pulley. A platen of metal or other hard material is located between the pulleys behind the metal band on the side opposite the print hammers. The platen resists displacement of the type band when struck by the hammers. A wear strip of thin plastic material is provided between the metal band and the platen. The wear strip acts as a barrier to prevent rapid wearing of the type band. The continuous sliding contact of the type band on the wear strip punctuated by the frequent impacts of the hammers causes the strip to wear to the point where it must be replaced. In wearing, residue from the wear strip adheres to the type band and along with other debris from the print medium becomes deposited on the drive surfaces of the pulleys. The deposits can build up in a more or less irregular pattern on the drive surface to the point where the path of travel of the type band is changed sufficiently to affect band tracking, print quality and may cause emitter damage. Prior attempts at correcting the problem have involved cleaning the type band. However, cleaning the type band does not effectively prevent buildup and causes band alignment and band wear problems and made it difficult and cumbersome to service and maintain the wear strip and cleaning mechanisms of the printer apparatus.

BACKGROUND ART

IBM Technical Disclosure Bulletin, Vol. 16, No. 1 June 1973 at page 143 shows a print belt cleaner which takes the form of a spring blade. The blade is notched and is provided with a magnet to maintain alignment to provide cleaning action without preloading the belt.

IBM Technical Disclosure Bulletin, Vol. 25, No. 7A December 1972 at page 3521 shows a replaceable plastic strip interposed between a stationary platen bar and an endless metal type band for preventing wear. The strip has terminals with apertures for attachment by screws to the platen.

SUMMARY OF THE INVENTION

It is the object of this invention to provide an improved wear prevention and cleaning device for use in a band printer.

It is also an object of the invention to provide a type band wear prevention and cleaning device which is disposable.

It is a further object of the invention to provide a type band wear prevention and cleaning device which can be readily and quickly replaced in a band printer apparatus.

It is another object of the invention to provide a retention device for a type band wear prevention and cleaning device that enables quick interchangeability by operating personnel and insures uniform installation and holding action.

Basically the invention provides an article which takes the form of a strip assembly comprising the combination of a wear strip designed for interpositioning between the type band and the backup surface of the platen and a wiper strip designed for continuously cleaning the drive surface of the drive pulley. Preferably the wear strip and wiper strip are made of plastic to thereby minimize wear of the type band and the platen. In the preferred embodiment, the wear strip is made of a polyester material such as a polyimide and preferably a polymide coated with a fluorocarbon or other low friction material and the wiper strip is made of polyester material such as polyethylene teraphthalate. The wear strip is relatively inelastic so that it can be held flat by the application of tension. The wear strip is elastic so that it can be bent to be spring loaded against the pulley drive surface. The two strips are attached together to form a strip assembly which can be easily handled and quickly and easily installed and removed from the platen, band and drive assembly which form the printer apparatus. The invention further provides a novel retention device affixed to the platen and having a construction which enables the strip assembly to be quickly assembled with the wear strip and wiper strip precisely located in position relative to the platen and the drive pulley mechanisms. The retention device is also designed to automatically adjust for elongation of the wear strip and to hold the wiper strip against the drive pulley drive surface in such a way that allows the wiper strip to self-align as wear occurs yet always maintains a relatively constant pressure for scraping off debris.

The foregoing and other objects, features and advantages of the invention will be apparent from the following more particular description of a preferred embodiment of the invention, as illustrated in the accompanying drawing.

DETAILED DESCRIPTION OF THE PRINTING APPARATUS

Figure 1:
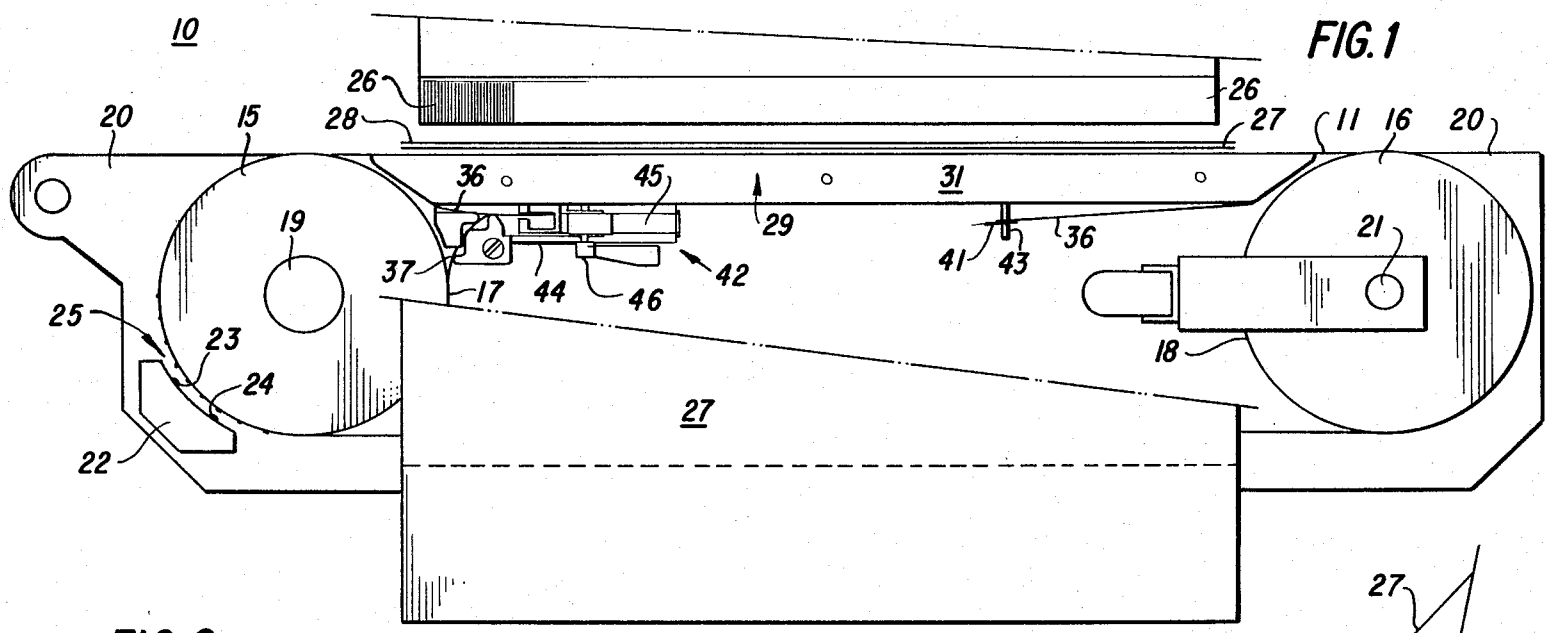
FIG. 1 is a schematic plan view of a printing apparatus to which the present invention is applicable.
Figure 3:
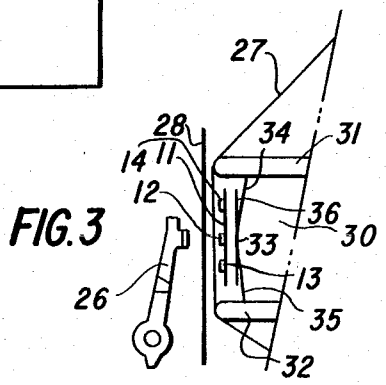
FIG. 3 is a sectional view of a portion of the apparatus shown in FIG. 1 taken along line A—A.
Figure 2:
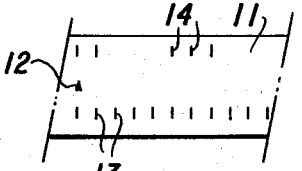
FIG. 2 is a front elevation showing a portion of a type band used in the apparatus of FIG. 1.

Referring to FIGS. 1–3, especially FIG. 1, a printing apparatus, generally designated by the numeral 10 comprises a flexible endless type band 11 constructed of, for example, nonferrous steel and having a set of type characters 12 with parallel rows of timing marks 13 and identification marks 14 formed on the outer face of band 11. Band 11 is trained around a drive pulley 15 and a driven or idler pulley 16 with the inner face of band 11 in partial frictional engagement with their respective drive surfaces 17 and 18. Drive pulley 15 is rotated by a motor (not shown) and drive shaft 19 journaled to base plate 20. Idler pulley 16 is rotatable on shaft 21 which is journaled to base plate 20 in a known manner to allow lateral adjustment of idler pulley 16 for tensioning and slackening of type band 11. Although not shown in the drawings, drive surface 17 of pulley 15 is a stepped surface that acts as a radius to type band 11 and drive surface 18 of idler pulley 16 is a crowned surface with a very large radius in order to make good frictional contact and to apply a slight bias to type band 11 to maintain a precise horizontal path of travel while revolving at constant speed. An emitter assembly 22 is fixed on base plate 20 with sensors 23 and 24 aligned with and separated from timing and identity marks 13 and 14 by operating gap 25. The dimension of operating gap 25 is desirably very small, e.g. in the order of several mils. Thus any deviation of the band 11 from its normal plane of travel around pulley 15 can seriously affect band tracking and might cause damage to sensors 23 and 24.

Outside the type band 11 are print hammers 26 arranged in a row facing a straight portion of type band 11. Ink ribbon 27 and paper 28 are positioned between type characters 12 on type band 11 and hammers 26. Ink ribbon 27 may be a wide ribbon which is fed between upper and lower feed rolls at a constant speed in alternately up and down directions. Paper 28 may be a continuous web fed vertically in an upward direction in increments of one or more line spaces at a time and then stopped for printing by tractor or feed roll devices (not shown).

A platen assembly 29 is provided between pulleys 15 and 16 inside type band 11 to provide an impact surface for the printing operation. As seen in greater detail in FIG. 3, platen assembly 29 comprises a backup plate 30 sandwiched between upper and lower guide plates 31 and 32. The front face of backup plate 30 has vertical backup surface 33 centered between rearwardly sloping relief surfaces 34 and 35. Platen assembly 29 is positioned on base plate 20 so that backup surface 33 is located directly in line with type characters 12 on type band 11 to thereby provide the impact surface for the printing operation. The front face of backup plate 30 may be coated, plated or case hardened to resist wear. Wear of type band 11 is prevented by wear strip 36 interposed between the inner face of type band band 11 and backup surface 33 of backup plate 30. For purposes of clarity in illustration wear strip 36 and type band 11 are shown to be separated. In reality, the inner surface of type band 11 and the wear strip 36 are in continuous contact during printing when type band 11 is placed under tension between pulleys 15 and 16. Wear strip 36 thereby is a barrier between type band 11 and backup plate 30 to prevent wear. Guide plates 31 and 32 extend forwardly beyond backup plate 30 to form a guideway for type band 11 and wear strip 36. The rounded forward edges of guide plates 31 and 32 provide smooth guide surfaces for ink ribbon 27.

In operation, type band 11 is placed in tension by locking pulley 16 in the rightmost position. Pulley 15 is then rotated counterclockwise causing type band 11 to be driven by the frictional contact of drive surface 17 of pulley 15 with the inner surface of type band 11. During printing, hammers 26 are selectively operated to impact paper 28 and ink ribbon 27 against selected type characters 12 thereby pressing type band 11 more strongly against wear strip 36 and backup surface 33 of backup plate 30. The continuous sliding contact of type band 11 and the repeated impacts of hammers 26 causes wear strip 36 to become worn to the point where its dimensions change and curling or wrinkling results which alters the character of the impact surface. Ultimately the wearing reaches the point where wear strip 36 must be replaced. Also debris from paper 28 and ink ribbon 27 along with residue from wear strip 36 become deposited on drive surface 17 of pulley 15 with the result that surface irregularities form which alter the condition of the pulleys and thereby affects band tracking. The surface irregularities can also affect the dimensions of the gap 25 which might cause inaccurate timing signals and possible sensor damage.

In accordance with this invention, wear strip 36 is combined with wiper strip 37 to form a strip assembly 38 which constitutes a convenient disposable unitary wear prevention and cleaning device for use in a printer apparatus of the type described. As seen in FIG. 3, wear strip 36 is relatively narrow so that it fits freely within the guideway between guide plates 31 and 32 of platen assembly 29 but adequately covers backup surface 33 and parts of relief surfaces 34 and 35 of backup plate 30. Wear strip 36 is also relatively thin, preferably in the range of a few mils, in order to avoid a cushioning effect and to allow wear strip 36 to be relatively inelastic and pliable so that it will wrap around platen assembly 29 and conform closely to the backup surface 33 when placed under tension. Preferably wear strip 36 is a plastic material which is a composite of a base film made of polyester such as a polyimide coated with a low friction material such as a fluorocarbon. A suitable material for the base film would, for example, be a polyethylene teraphthalate and the coating material would be one of the TFE polymers tetrafluoroethylene both marketed under the trademarks Mylar and Teflon respectively by E. I. duPont de Nemours Co. Wiper strip 37 is a relatively thicker Mylar film to give it rigidity and elasticity so that it can be spring loaded when bent or deflected from its normal plane. In accordance with this invention, wiper strip 37 is attached to wear strip 36 to form an end connection in which strip assembly 38 is easily installed with platen assembly 29 so that wiper strip 37 can be readily and precisely positioned against drive surface 17 of pulley.

Figure 6:
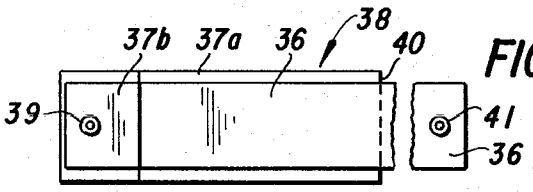
FIG. 6 is a plan view of the wear/wiper strip article used in the apparatus of FIG. 1.
Figure 7:
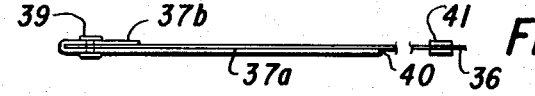
FIG. 7 is a side elevational view of the wear/wiper strip article of FIG. 6.

Wiper strip 37, as seen in FIGS. 6 and 7, is preferably a single piece of plastic having a wiper portion 37*a* and a stub portion 37*b* folded over and attached to one end of wear strip 36 by an eyelet 39 or similar fastener element to thereby form a reinforced end connection for attachment to retention mechanism 42 (see FIG. 1). As seen in FIG. 6, wiper strip 37 is also wider than wear strip 36 for ease of handling. Wiper portion 37*a* terminates in a transverse straight scraper edge 40 designed, under spring loading, to bear against and scrape deposits from drive surface 17 of drive pulley 15. Wiper portion 37*a* has a length sufficient to permit scraper edge 40 to engage drive surface 17 when held by quick release retention device 42. The other end of wear strip 36 of strip assembly 38 has eyelet 41 for quick release attachment to fixed attachment pin 43 on platen assembly 29.

Retention device 42, in accordance with this invention, is a mechanism designed for quick reception and release of the reinforced end connection of strip assembly 38. It is also designed with means for holding the same end connection of strip assembly 38 in a manner which insures uniform manual installation and a holding force whereby wear strip 36 is maintained under constant tension even when its length changes by wear and insures that wiper strip 37 is positively located and held on drive surface 17 of drive pulley 15. Basically retention device 42 comprises an assembly consisting of mounting block 44 attached to base plate 20, slider assembly 45 movably supported by mounting block 44, and operator element 46 supported by mounting block 44 and operable for moving slider assembly 45 to various positions within predetermined limits to enable manual attachment and removal of the reinforced end connection of strip assembly 38 to slider assembly 45 and to apply controlled tension to wear strip 36 and to position of wiper strip 37 during printing. Mounting block 44, slider assembly 45 and operator element 46 are preferably plastic molded pieces where their component elements are formed as integral parts through molding processes.

Figure 4:
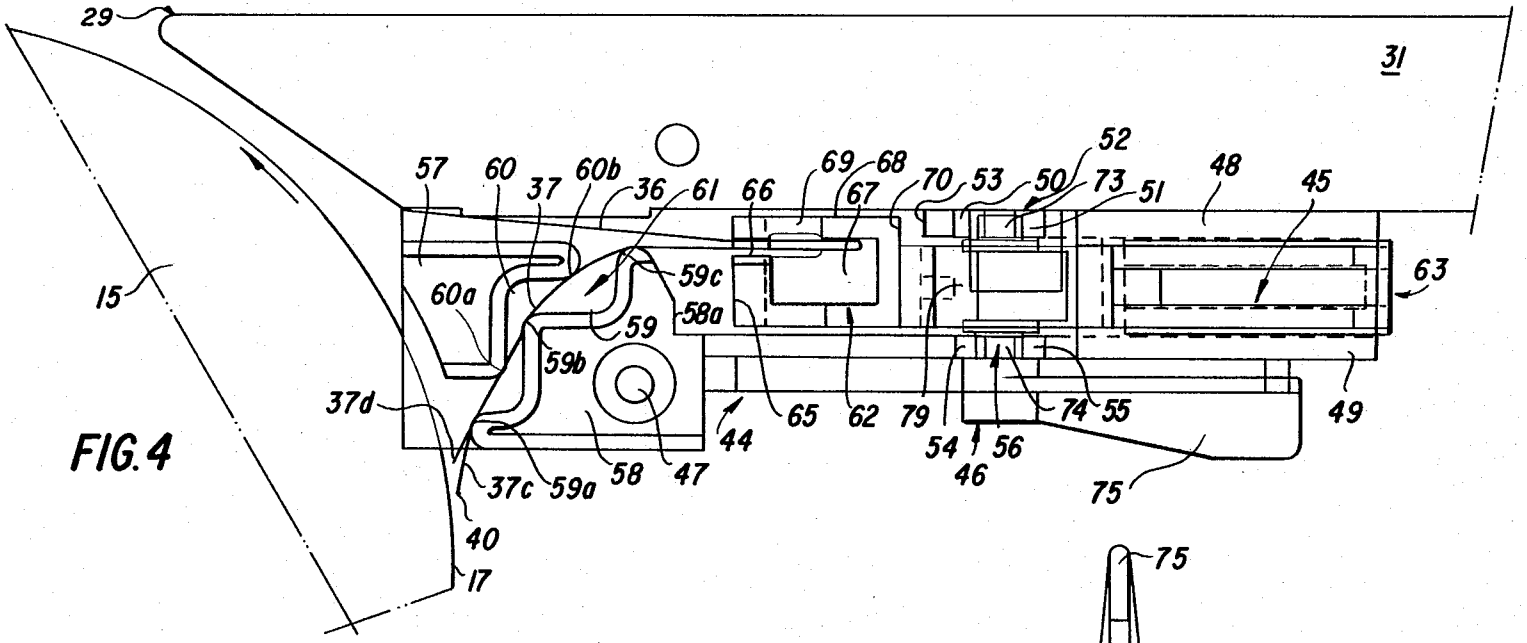
FIG. 4 is an enlarged plan view showing the retention device used in the apparatus of FIG. 1.
Figure 5:
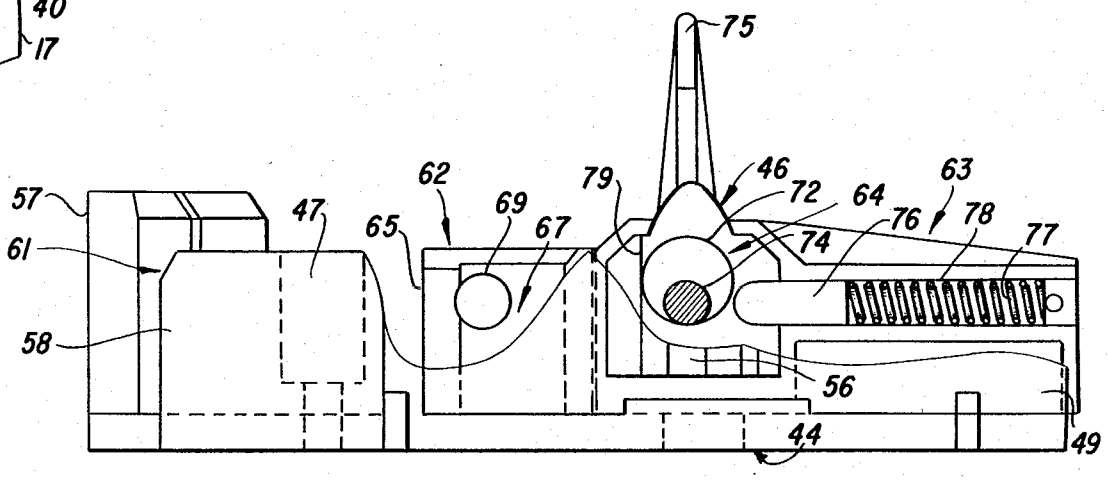
FIG. 5 is a side elevation of the retention device shown in FIG. 4.

As seen in FIGS. 4 and 5, mounting block 44 has mounting hole 47 whereby it may be fastened by screws (not shown) or other means to base plate 20 in proximity with drive pulley 15 and platen assembly 29. Mounting block 44 has parallel guide walls 48 and 49 which form a linear guide channel for slider assembly 45 whereby it can be held and reciprocated manually relative to drive surface 17 of drive pulley 15. Co-planar with guide wall 48 are parallel fingers 50 and 51 separated by a slot 52 which form one journal for attaching operator element 46 on mounting block 44. The leading edge 53 of finger 50 serves as a rear stop for slider assembly 45. Similarly guide wall 49 has parallel fingers 54 and 55 with slot 56 which form a second journal for rotatably supporting operator element 46.

At its forward end, mounting block 44 has guide posts 57 and 58 with parallel facing stepped guide surfaces 59 and 60 respectively forming a sinuous or stepped guide slot 61 for receiving and holding wiper strip 37 in spring loaded condition so that scraper edge 40 is in continuous contact with drive surface 17 at a constant pressure. Guide post 58 has stop surface 58*a* which limits forward movement of slider assembly 45. Guide surface 59 has a set of rounded guide edges 59*a–c* for engaging one surface of wiper strip 37. Guide surface 60 has a second set of rounded guide edges 60*a–b* offset laterally from guide edges 59*a–c* for engaging the opposite surface of wiper strip 37. Together the two sets of offset guide edges form a precisely defined guide slot 61 in which wiper strip 37 is easily inserted edgewise. Wiper strip 37 wears during cleaning of drive surface 17 but the entry angle at which it is held in slot 61 is designed to allow for such wear. As wiper strip 37 wears, it self-aligns over the range shown by the numerals 37*c–d* in FIG. 4.

Slider assembly 45 comprises a molded slider block having holder portion 62 and guide portion 63 and a passageway 64 (see FIG. 5) which is occupied by operator element 46. Forward wall 65 of holder block 62 has retention slit 66 connected to retention cavity 67. Sidewall 68 of holder block 62 has aperture 69 into retention cavity 67. Retention slit 66 is wide enough for wear strip 36 and wiper strip 37 to be easily inserted edgewise but is too narrow for the reinforced end connection to be pulled through it from cavity 67. Aperture 69 is made large enough so that eyelet 39 will seat therein thereby acting to position and hold wear strip 36 and wiper strip 37 in the desired alignment relative to platen assembly 29 and drive pulley 15. Rear wall 70 and forward wall 65 are coactable with stop surface 53 of finger 50 and stop surface 58*a* of guide post 58 respectively to limit the rearward and forward movement of the slider block assembly 45.

The guide portion 63 of slider assembly 45 is designed to be held and be slidable within the guideway between guide walls 48 and 49. Operator element 46 as seen in FIGS. 4 and 5 has eccentric cam 72 within passageway 64 of the slider block, end shafts 73 and 74 within slots 52 and 56 so as to be journaled to guide walls 48 and 49, and operator handle 75 for rotating cam 72. Cam follower 76 and bias spring 77 housed in recess 78 of guide portion 63 causes slider assembly 45 to be biased to the right so that edge 79 of passageway 64 bears against and follows cam 45 in response to rotation of operator handle 75. When operator handle 75 is in the horizontal position shown in FIG. 4, cam 72 loads spring 77 applying a bias force for tensioning wear strip 36. When moved to the vertical position shown in FIG. 5, operator handle 75 has caused slider assembly 45 to move to an intermediate position at which tension on wear strip 36 is lessened or removed depending on the extent to which the length of wear strip 36 has increased as a result of wear during printing. If desired, operator handle 75 can be rotated counterclockwise from the vertical position of FIG. 5 causing cam 72 to move slider assembly 45 to its leftmost position at which the reinforced end connection of strip assembly 38 can be most easily attached to holder portion 62 and wear strip inserted into guide slot 61.

The procedure for removing and installing the strip assembly 38 into the printing apparatus 10 will be described. Referring to FIGS. 1–7, ink ribbon 27 is first removed. Type band 11 is then removed. This is done by unlocking and moving idler pulley 16 on base plate 20 to allow type band 11 to become slack. One end of wear strip 36 is attached to platen assembly 29 by sliding eyelet 41 onto attachment pin 43 then wrapping wear strip 36 around platen assembly 29 through the guide path formed by guide plates 31 and 32. With operator handle 75 rotated 180 degrees from the position shown in FIG. 4, wear strip 36 and wiper strip 37 are manually separated to allow wiper strip 37 to be aligned with and inserted into guide slot 61 while inserting wear strip 36 and wiper strip 37 into retention slit 66 in forward wall 65 of holder block 62 and eyelet 39 and the reinforced end connection into retention cavity 67. When fully inserted and with eyelet 39 seated in aperture 69 of sidewall 68, operator handle 75 is rotated clockwise to take up the slack in wear strip 36 and draw wiper strip 37 through guide slot 61 to begin adjusting the entry angle and spring load condition of scraper edge 40 against drive surface 17 of drive pulley 15. The rotation of operator handle 75 is continued until it arrives at the right horizontal position of FIG. 4 during which wear strip 36 becomes taut to stop further movement of slider assembly 45 to the right whereupon scraper edge 40 is located at its initial cleaning position and cam 72 compresses spring 75 to apply maximum tension to wear strip 36 to achieve maximum flatness against backup surface 33 of backup plate 30. Type band 11 is then wrapped on pulleys 15 and 16 and tensioned by moving and locking idler pulley 16 on base plate 20 and ink ribbon 27 reassembled over the edges of guide plates 31 and 32. During printing, as wear strip 36 elongates, slider assembly 45 will be moved to the right by spring 77 keeping wear strip 36 under tension and drawing wiper strip 37 further through guide slot 61 and thereby adjusting the entry angle of scraper edge 40 while maintaining the pressure relatively constant.

For replacing the strip assembly 38, the procedure is the same. Because of the simplicity of the wear strip assembly and the retention mechanisms, the process of installation and removal is greatly simplified and can be done in minimum time with improved accuracy and precision to obtain improved wear prevention and cleaning to produce better quality printing.

While the invention has been particularly shown and described with reference to a preferred embodiment thereof, it will be understood by those skilled in the art that various changes in form and detail may be made therein without departing from the spirit and scope of the invention.

We claim:

1. In a printing apparatus having rotatably mounted drive and idler pulleys with friction drive surfaces, an endless flexible metal type band being engaged and partially wrapped around said drive surfaces of said drive and idler pulleys and in tension therebetween, hammer means placed at one side of said endless type band for striking a print medium against type faces carried by said type band, and a platen placed at an opposite side of said endless type carrier between said pulleys to provide an impact surface for printing, a strip assembly for use in said printing apparatus comprising a wear strip of plastic material removably attachable to said platen to form a barrier to reduce wear of said type band between said type band and said platen, said wear strip having a portion with a surface in sliding contact with said opposite side of said type band whereby residue from said wear strip as well as other debris become deposited on said drive surface of said drive pulley during printing, and a wiper strip of plastic material attached to said wear strip at an end attachable in the vicinity of said drive pulley, said wiper strip having a wiper portion extending away from the attachment point with said wear strip and terminating in a scraping edge, said wiper portion being sufficiently long to permit said wiper strip to be deflected outwardly from said wear strip to bring said scraper edge into continuous contact with the drive surface of said drive pulley whereby said scraper edge of said wiper strip operates to scrape deposited material from said drive surface of said drive pulley for cleaning said type band and said drive surface.

2. In a printer apparatus, a strip assembly in accordance with claim 1 in which said wear strip is a thin plastic material which is relatively inelastic, and said wiper strip is a plastic material which is relatively elastic so as to be spring loadable.

3. In a printer apparatus, a strip assembly in accordance with claim 2 in which said wiper strip has a folded portion at an end opposite said scraper edge, said wiper portion and said folded portion being wrapped around said end of said wear strip and attached thereto to form a reinforced end connection for attachment in the vicinity of said drive surface.

4. In a printer apparatus which in accordance with claim 3 further comprises retention means attachable to said reinforced end connection of said strip assembly in a manner whereby said wear strip is held under tension and said wiper strip is held in spring loaded condition with said scraper edge in engagement with said drive surface.

5. In a printer apparatus in accordance with claim 4 in which said retention means is manually operable to enable attachment to said reinforced end connection and then applying tension to said wear strip.

6. In a printer apparatus in accordance with claim 5 in which said retention means comprises stationary mounting means, slider means movably mounted on said mounting means, said slider means have means attachable to said end connection of said strip assembly, and a manual operator means for moving said slider means to a first position on said mounting means for attachment with said end connection and to a second position for applying tension to said wear strip.

7. In a printing apparatus in accordance with claim 6 in which said mounting means guide includes means proximate said slider means for holding said wear strip in spring loaded condition with said scraper edge in contact with said drive surface.

8. In a printer apparatus in accordance with claim 7 in which said means for holding said wiper strip in spring loaded condition comprises post members affixed to said mounting means and forming a guide slot for receiving and holding said wiper strip at a predetermined entry angle at which said said wiper strip is held in spring loaded condition against said drive surface.

9. In a printer apparatus in accordance with claim 8 in which said guide slot formed by said post members is a stepped guide slot.

10. In a printer apparatus in accordance with claim 9 in which said post members have guide surfaces with a plurality of offset guide edges for forming said stepped guide slot.

11. In a printer in accordance with claim 6 in which said slider means includes spring means conditionable by said manual operator means for applying tension to said wear strip during printing.

12. In a printer apparatus in accordance with claim 11 in which said slider means is movable in said second position in response to said conditioned spring means for adjusting for elongation of said wear strip caused by wearing during printing.

13. In a printer apparatus in accordance with claim 6 in which said manual operator means is further operable for moving said slider means on said mounting means for adjusting the position of contact of said scraper edge of said wiper strip on said drive surface.

14. In a printer apparatus in accordance with claim 11 in which said manual means includes cam means for moving said slider means to said first and second positions and for conditioning said spring means for applying tension to said wear strip.

15. In a printer apparatus, a strip assembly in accordance with claim 2 in which said plastic material of said wear strip comprises a polyester base material coated with a polymer, and said plastic material of said wiper strip is a relatively thick polyester material.

16. In a printer apparatus, a strip assembly in accordance with claim 15 in which said polyester material material is a polyethylene teraphthalate material, and said polymer material is a TFE polymer.

17. A strip assembly for a printing device wherein said printing device includes rotatably mounted drive and idler pulleys with friction drive surfaces, an endless flexible type band engaged with both said drive and idler pulley to move around said pulleys, said endless type band being partially wrapped around both said drive and idler pulleys and in tension therebetween, hammer means placed at one side of said endless type band for striking a print medium against type characters supported by said type band, and a platen placed at an opposite side of said endless type band, said strip assembly comprising a wear strip made of polyester material and having a wear surface of low friction material, said wear strip having opposite end portions adapted for attachment to said platen with one of said end portions proximate said drive pulley and a middle portion interposed between said type band and said platen whereby said wear strip forms a barrier with said wear surface in contact with said type band, and a wiper strip made of polymer material attached to said wear strip at the end portion proximate said drive pulley, said wiper strip having a portion extending away from the point of attachment with said wear strip, said portion extending away terminating in a scraper edge and being sufficiently long to permit said wiper strip to be deflected away from said wear strip when attached near said drive pulley to bring said scraper edge into spring loaded contact with the drive surface of said drive pulley.

18. A strip assembly for a printing device in accordance with claim 17 in which said wear strip comprises a polyester base material coated with a polymer material, and said wiper strip is a relatively thick polyester material.

19. A strip assembly for a printing device in accordance with claim 18 in which said polyester base material is a polyethylene teraphthalate material, and said polymer material is a TFE polymer.

20. A strip assembly for a printing device in accordance with claim 19 in which said wiper strip is a TFE polymer.

* * * * *